US007854032B2

(12) United States Patent
Igwemezie et al.

(10) Patent No.: US 7,854,032 B2
(45) Date of Patent: Dec. 21, 2010

(54) PORTABLE RAMP FOR MOTOR VEHICLES

(75) Inventors: Jude Igwemezie, Brampton (CA); Tuan Nguyen, Brampton (CA)

(73) Assignee: Scepter Corporation, Scarborough, ON (CA)

( * ) Notice: Subject to any disclaimer, the term of this patent is extended or adjusted under 35 U.S.C. 154(b) by 449 days.

(21) Appl. No.: 11/874,056

(22) Filed: Oct. 17, 2007

(65) Prior Publication Data

US 2009/0100613 A1 Apr. 23, 2009

(51) Int. Cl.
*E01D 1/00* (2006.01)

(52) U.S. Cl. ..... 14/69.5

(58) Field of Classification Search ..... 52/80.2, 52/87, 176, 637; 14/69.5; D34/32; 254/88
See application file for complete search history.

(56) References Cited

U.S. PATENT DOCUMENTS 4,050,403 A * 9/1977 Miller ..... 254/88
4,587,684 A * 5/1986 Miller ..... 14/24
5,033,146 A * 7/1991 Fogarty et al. ..... 14/69.5
5,483,715 A * 1/1996 Fogarty et al. ..... 14/69.5
5,590,433 A * 1/1997 Fricke ..... 14/24
6,993,801 B2 * 2/2006 Marko et al. ..... 14/69.5
7,003,836 B2 * 2/2006 Berg ..... 14/69.5
7,104,524 B1 * 9/2006 Hidding et al. ..... 254/88
D567,471 S * 4/2008 Haimoff ..... D34/33
D602,673 S * 10/2009 Allen ..... D34/32
2008/0201873 A1 * 8/2008 Haimoff ..... 14/69.5

* cited by examiner

*Primary Examiner*—Gary S Hartmann
(74) *Attorney, Agent, or Firm*—Ogilvy Renault LLP

(57) ABSTRACT

A portable ramp for motor vehicles molded from co-polymer where the ramp has a longitudinal spine extending through a grid, has a sloped portion and a horizontal upper portion to support a wheel of a vehicle. The wheel is in direct contact with the grid and the grid is open from top to bottom between the spine and the side walls. The spine has an arc-shaped cross-section.

25 Claims, 6 Drawing Sheets

PORTABLE RAMP FOR MOTOR VEHICLES

BACKGROUND OF THE INVENTION

1. Field of Invention

This invention relates to a portable ramp for use on a supporting surface with a motor vehicle to raise part of the vehicle above a supporting surface, the ramp containing a spine extending longitudinally therein.

2. Description of the Prior Art

Portable ramps for motor vehicles are known. The Fogarty et al U.S. Pat. No. 5,483,715 issued Jan. 16, 1996 describes a vehicle service ramp made from a foamed polymer where the ramp has a rear wall, a pair of side walls and a front. The front includes a surface sloping upward to a top surface. The ramp has an internal structure forming a honeycomb pattern of support walls extending between the rear wall, the side walls and the front. The front includes an upward sloping surface and a top plain surface on which the tire of the vehicle is to rest. The front extends across the ramp between the two side walls and the tire of a vehicle that utilizes the ramp is in contact with the front at all times. The honeycomb pattern extends from beneath the front to a supporting surface upon which the ramp rests.

Previous motor vehicle ramps are too expensive, too heavy, too weak or the ramp tends to slip away from the vehicle as the vehicle is driven onto the ramp.

SUMMARY OF THE INVENTION

It is an object of the present invention to provide a portable ramp for motor vehicles that is light weight, strong and durable and does not move away from the vehicle as the vehicle is driven onto the ramp. It is a further object of the present invention to provide a portable ramp for use with a motor vehicle where the ramp has a spine extending longitudinally therein with a grid extending upward from the spine to a top and downward from the spine to a bottom of the ramp.

A portable ramp for use on a supporting surface for raising part of a motor vehicle above the surface as used with a motor vehicle having wheels thereon. The ramp comprises a sloped portion and an upper portion, the ramp having a top, a bottom, two sides, a first end and a second end. There are two ends, the first end being located at a lower end of the sloped portion. The ramp has a spine extending longitudinally therein between the ends, the spine having an arc-shaped cross-section that is open toward the bottom. A grid extends upward and downward from the spine between the sides. The ramp is sized and shaped to enable one wheel of the vehicle to travel in contact with the grid from the first end up the sloped portion to the upper portion and vice versa.

DETAILED DESCRIPTION OF A PREFERRED EMBODIMENT

Figure 1:
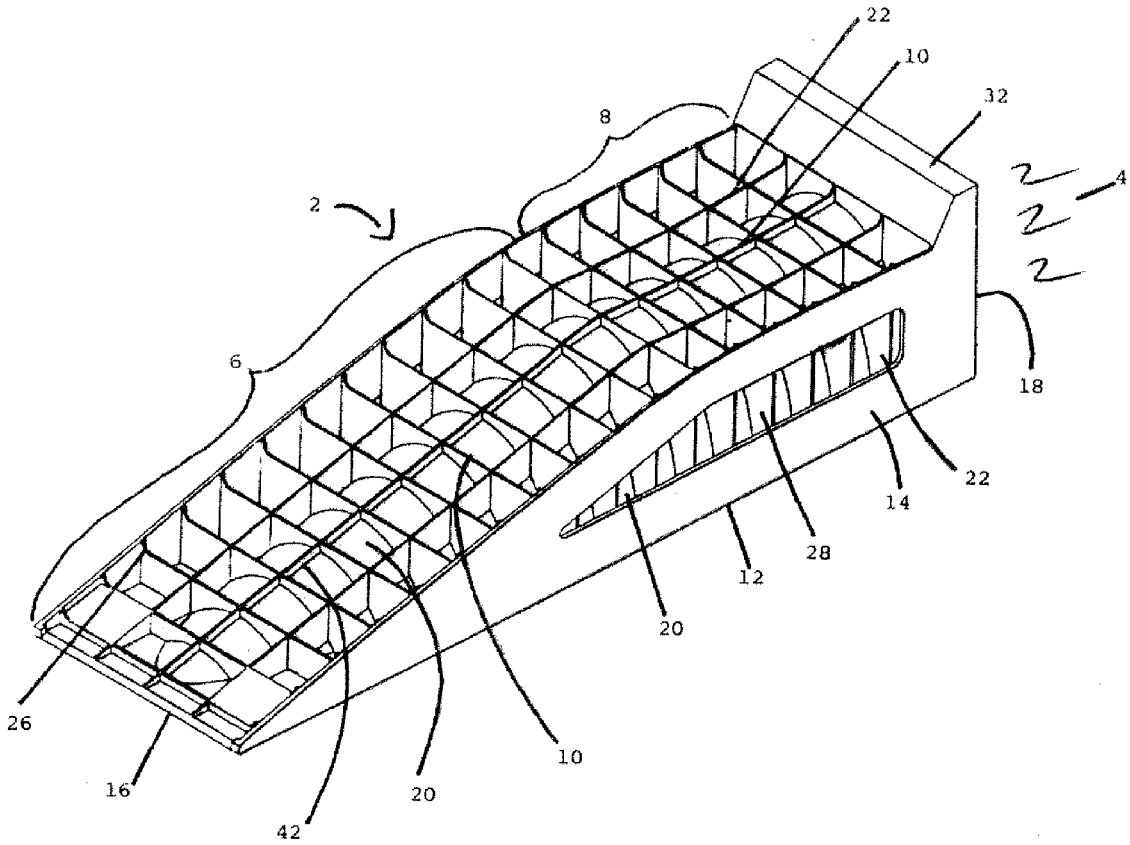
FIG. 1 is a perspective view of a portable ramp when viewed from a top.
Figure 2:
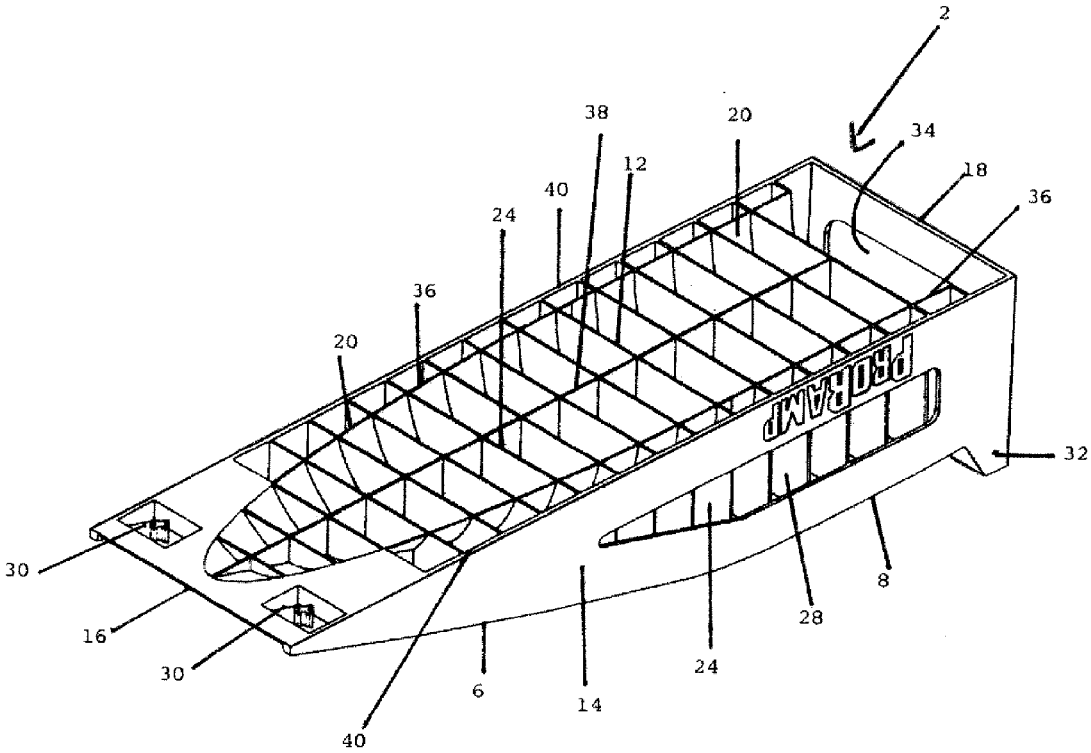
FIG. 2 is a perspective view of the portable ramp of FIG. 1 turned upside down.

In FIGS. 1 and 2, there is shown a perspective view from a top and an upside perspective view respectively of a portable ramp 2 for use on a supporting surface 4 for raising part of a motor vehicle (not shown) above said surface 4. The ramp 2 has a sloped portion 6 and an upper portion 8. The upper portion 8 is preferably parallel with the supporting surface 4. The ramp has a top 10, a bottom 12, two sides 14, a first end 16 and a second end 18. A spine 20 extends longitudinally between the two ends 16, 18. A first grid 22 extends upward and outward from the spine 20 and a second grid 24 extends downward from the spine 20 between said sides 14. The grid (first and second) is substantially vertical when said ramp is in an upright position. The ramp 2 is sized and shaped to enable one wheel (not shown) of said vehicle (not shown) to travel in contact with said grid 22 from said first end 16 up said sloped portion 6 to said upper portion 8 and vice versa. It can be seen that the first grid 22 is divided into rectangular shapes that are substantially the same size throughout, there being four rectangles between the two sides. Further, it can be seen that the first grid 22 extends upward at a point 26 along each of the sides 14. The upward portion 26 is hidden by the side 14 on the near side of FIG. 1. The upward portions 26 create a trough between the upper portions 26 in which the tire (not shown) can travel. Each of the sides 14 has an opening 28 therein to reduce the weight of the ramp 2. In FIG. 2, there are two depressions 30 near the first end 16 on the bottom 12 of the ramp 2. The depressions 30 are sized and located to receive a flexible insert (not shown in FIGS. 1 and 2). The purpose of the insert is to provide the ramp with better friction against the supporting surface 4 to prevent the ramp from moving away from the motor vehicle as the motor vehicle is being driven up the ramp. The end 18 has an end wall 32 extending upward from the bottom 12 above the first grid 22 to provide a stop for the tire (not shown) of the motor vehicle (not shown). The end wall 32 has an opening 34 therein to reduce the weight of the ramp 2.

The second grid 24 has a different shape from the first grid 22. The spine 20 has a lower edge 36 extending along the bottom 12 of the ramp 2. The lower edge 36 and the spine 20 itself converge in the sloped portion 6. The spine 20 has a constant width in an area of the upper portion 8. The second grid 24 has a lower edge 38 and the sides 14 each have a lower edge 40. When the ramp 2 is located on the supporting surface 4, the lower edges 36, 38, 40 are all preferably in contact with the supporting surface 4. The lower edges of said second grid 24 also preferably extend to said bottom 12.

The spine 20 diverges laterally from the first end 16 to a point in the sloped portion 6 near the upper portion 8. The spine 20 extends between the first end 16 and the second end 18 but ends before reaching either of the two ends 16, 18. The spine 20 has an upper surface 42 along an imaginary longitudinal centreline of said ramp 2 located slightly beneath the top 10 of the grid 22.

Figure 3:
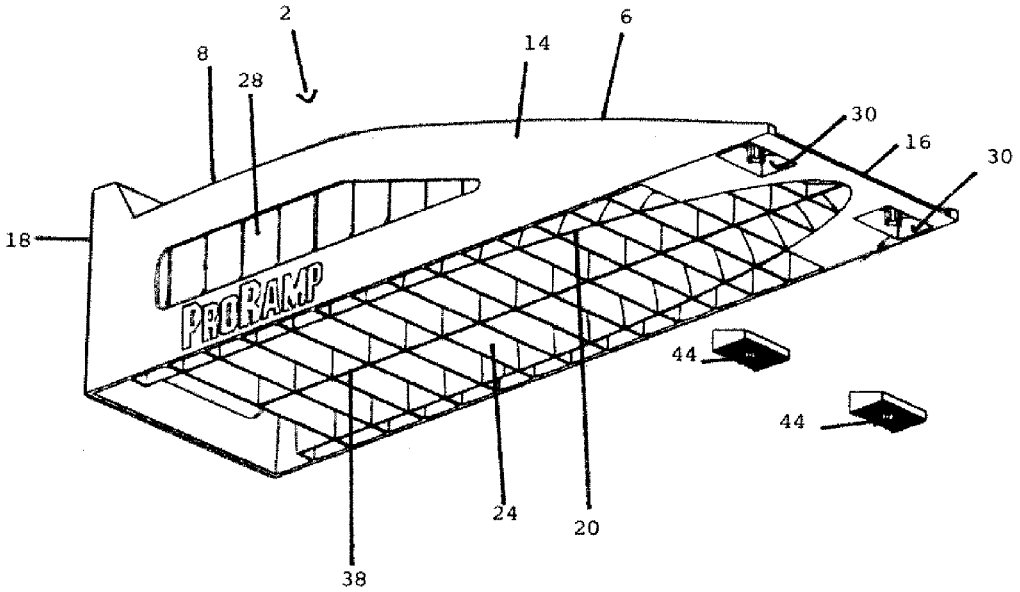
FIG. 3 is an exploded perspective view of a portable ramp when viewed from a bottom.
Figure 4:
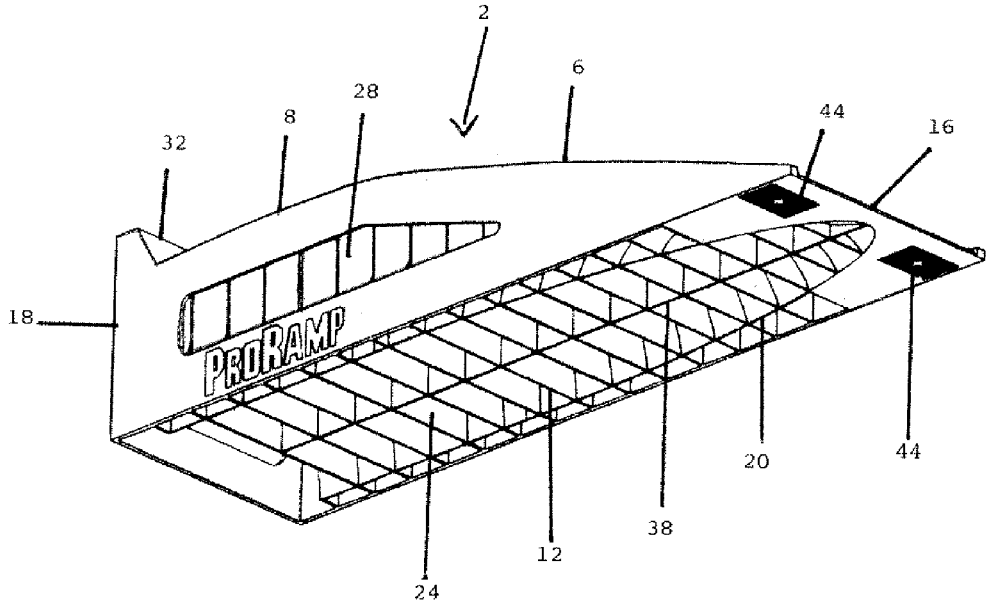
FIG. 4 is a perspective of said portable ramp when viewed from a bottom with inserts installed.

In FIGS. 3 and 4, inserts 44 are shown in an exploded view in FIG. 3 and installed in FIG. 4. The inserts 44 are installed in the two depressions 30. The inserts 44 provide a friction surface near the first end 16 in contact with the supporting surface (not shown in FIGS. 3 and 4). The same reference numerals are used in FIGS. 3 and 4 as those used in FIGS. 1 and 2 to describe those components that are identical but fewer components are numbered than in FIG. 2 to avoid overcrowding. Preferably, the inserts 44 are made from rubber, neoprene or some other generally rigid but somewhat flexible material that will provide friction relative to the supporting surface (not shown in FIGS. 3 and 4).

Figure 5:
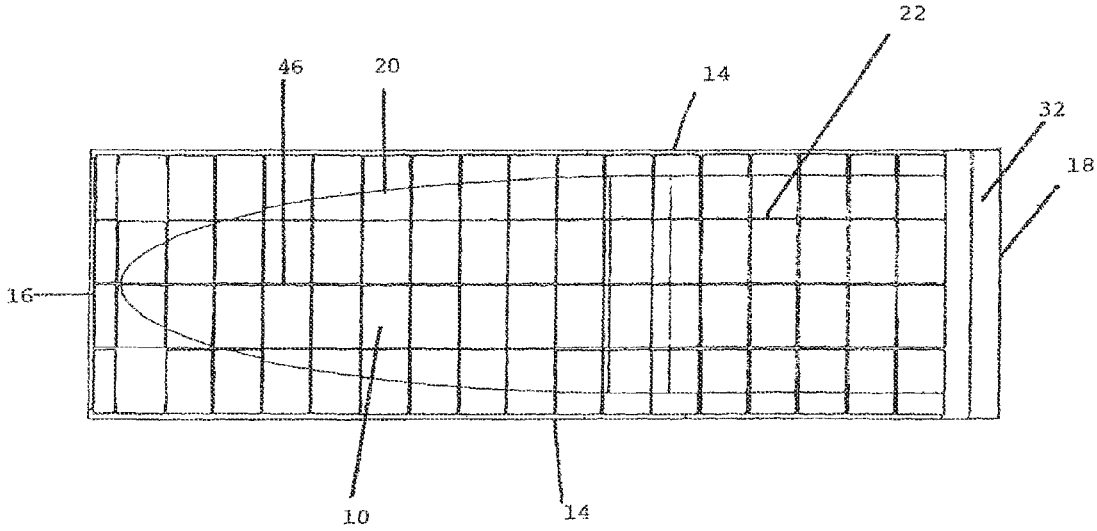
FIG. 5 is a top view of said portable ramp.
Figure 6:
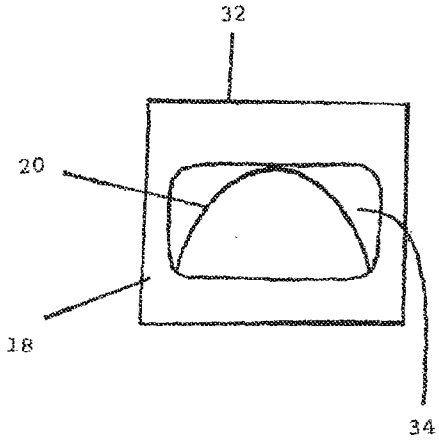
FIG. 6 is an end view of said ramp from a second end.
Figure 7:
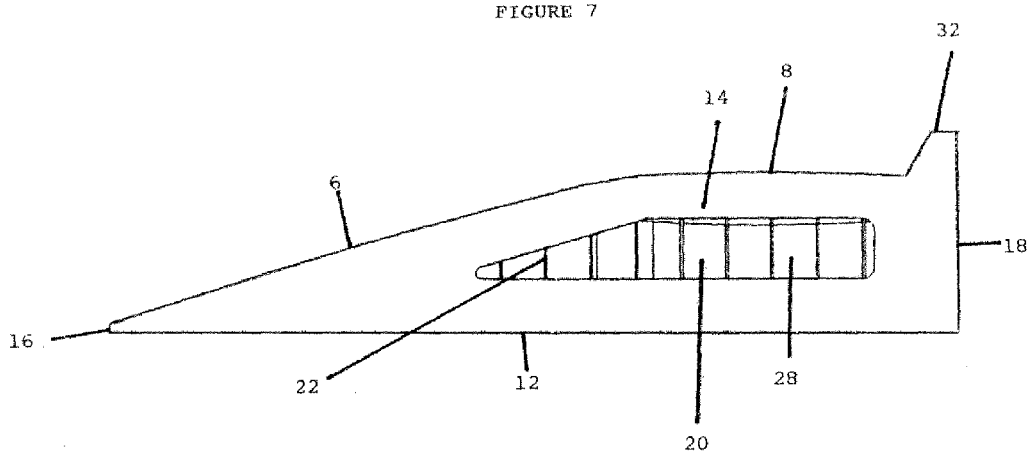
FIG. 7 is a side view of said ramp.
Figure 8:
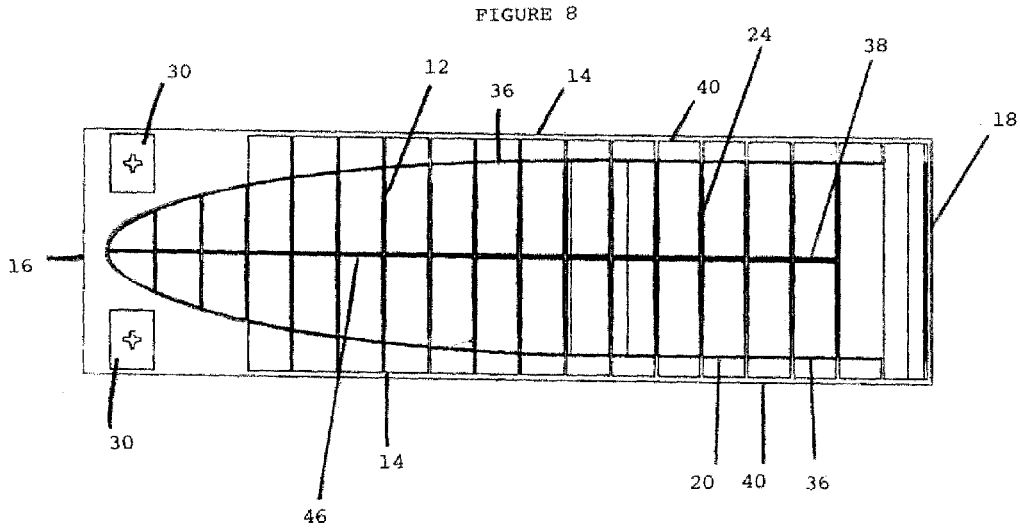
FIG. 8 is a bottom view of said ramp.

In FIGS. 5, 6, 7 and 8, there is shown a top view, end view, side view, and bottom view of the ramp 2 respectively. The same reference numerals are used in FIGS. 5 to 8 as those used in FIGS. 1 to 4 for those components that are identical. The inserts 44 are not shown in FIG. 8. From FIG. 6, it can be seen that the spine 20) has a parabolic cross-section. While the spine 20 preferably has a parabolic cross-section, the spine can have any arc-shaped cross-section that is open toward said bottom 12. The elongated shape and location of the spine 20 between the first end 16 and the second end 18 is clearly shown in FIGS. 5 and 8. The spine 20 is preferably symmetrical about a longitudinal centreline of the ramp 2 and the ramp itself is also preferably symmetrical about a longitudinal centreline of the ramp. From FIG. 6, it can be seen that the parabolic cross-sectional shape of the spine 20 causes the sides of the spine to diverge to the lower edges (not shown in FIG. 6). While the first grid 22 is aligned longitudinally with the second grid 24, the two grids are not aligned laterally. The ramp 2 could be designed with the first and second grids aligned with one another longitudinally and laterally. While there are two grids, the ramp can be described as having one grid with a varying shape above and outside of the spine compared to the shape of the grid beneath the spine. The first grid 22 is open from the top 10 to the bottom 12 between the spine 20 and the sides 14 as best shown in FIGS. 5 and 8. Therefore, if the motor vehicle is dripping water or has snow that is melting, the water or snow will fall through the ramp. With previous ramps, which have an upper surface extending along and across the entire sloped portion and upper portion, any moisture from the vehicle or melting snow will drain down the slope and the moisture will tend to accumulate in one area on the supporting surface near the first end 16 rather than being dispersed throughout the ramp 2. Preferably, the ramp 2 is molded and constructed in one piece and while the grid 22 has a different shape than the grid 24, if desired, the grid extending upward and outward from the spine 20 can have the same shape and orientation as the grid extending downward from the spine 20. As can be seen from FIGS. 5 and 8, the rectangles of the grid 24 are much larger within the spine 20 than the rectangles of the grid 22 outside and above the spine 20. It can also be seen that the rectangles within the sloped portion 6 vary in size as the spine curves in the sloped portion.

The ramp 2 does not have a continuous supporting surface for the tire (not shown) of the motor vehicle (not shown) extending between the sides from the first end to the second end as prior art ramps have. Preferably, the ramp is constructed and molded in one piece, and is made from expanded polymer material or co-polymer material. Preferably, the material is one selected from the group of polypropylene, high input polystyrene, polyethylene, polyphenyleneoxide, polycarbide, thermoplastic polyester, polyurethene, polyvinyl chloride, and the like. Polypropylene is preferred. The ramp 2 has a longitudinal rib 46 located between the sides 14.

The longitudinal rib 46 is the only longitudinal rib located between the sides 14 that is not part of the spine 20 and the rib 46 extends along a centreline of the ramp 2. Additional longitudinal ribs can be added, but are not required and are not preferred. The longitudinal rib 46 extends downward and upward from the spine 20. From FIG. 8, it can be seen that there are no openings through the ramp 2 in the area near the first end 16. The sides 14 are preferably side walls. The longitudinal rib 46 does not extend to the second end 18 or to the first end 16 but extends between the ends. It can be seen from FIG. 8 and also from FIGS. 2, 3 and 4 that the spine 20 extends beyond the longitudinal rib 46 toward the second end 18.

The grid extending upward and outward from the spine has a different size from the grid extending beneath the spine. The grid extending upward and outward from the spine has identically shaped rectangles whereas the grid extending beneath the spine has rectangles that are shaped differently (i.e. are larger) from the grid extending upward from the spine. The grid extending upward and outward from the spine is higher along the side walls than the remainder of the grid between the side walls. While the grid has a rectangular or square shape and the rectangular shape is preferred, other shapes of grid can be used and the grid extending upward and outward from said spine can have a different shape than the grid extending beneath said spine. For example, the grid can have a circular, elliptical, oval, pentagonal, diamond, hexagonal, or cross-sectional shape. Preferably, two ramps are used simultaneously to raise either the rear wheels or the front wheels of a vehicle above the supporting surface.

We claim:

1. A portable ramp for use on a supporting surface for raising part of a wheeled motor vehicle above said surface, said ramp comprising a sloped portion and an upper portion, said ramp having a top, a bottom, two sides, a first end and a second end, there being two ends, said first end being located at a lower end of said sloped portion, said ramp having a spine extending longitudinally therein between said ends, said spine having an arc-shaped cross-section that is open toward said bottom, with a grid extending upward and downward from said spine between said side walls, said ramp being sized and shaped to enable one wheel of said vehicle to travel in contact with said grid from said first end up said sloped portion to said upper portion and vice-versa.

2. A ramp as claimed in claim 1 wherein said spine converges toward said first end.

3. A ramp as claimed in claim 2 wherein said spine is narrower than said ramp.

4. A ramp as claimed in claim 3 wherein said grid extends outward beyond said spine to said side walls.

5. A ramp as claimed in claim 1 wherein said grid is rectangular.

6. A ramp as claimed in claim 1 wherein said grid has a shape selected from the group of rectangular, square oval, elliptical, circular, diagonal and diamond.

7. A ramp as claimed in claim 1 wherein said spine has a parabolic cross-section.

8. A ramp as claimed in claim 7 wherein said spine has two lower edges.

9. A ramp as claimed in claim 8 wherein said lower edges extend to said bottom.

10. A ramp as claimed in claim 1 wherein a cross-section of said spine diverges to said lower edges.

11. A ramp as claimed in claim 1 wherein said spine commences near said first end and extends to an imaginary vertical plain near said second end.

12. A ramp as claimed in claim 1 wherein said spine extends between said ends.

13. A ramp as claimed in claim 11 wherein said spine diverges laterally from a said first end to a point in said sloped portion near said upper portion, said spine having a constant width from said point to said end of said spine in said second portion.

14. A ramp as claimed in claim 1 wherein said spine has an upper surface along an imaginary longitudinal centreline located slightly beneath the top of said grid.

15. A ramp as claimed in claim 1 wherein said spine is symmetrical about a longitudinal centreline of said ramp.

16. A ramp as claimed in claim 1 wherein said ramp is symmetrical about a longitudinal centreline of said ramp.

17. A ramp as claimed in claim 1 wherein said grid is substantially vertical and extends to said bottom.

18. A ramp as claimed in claim 1 wherein said grid is open from top to bottom between said spine and said side walls.

19. A ramp as claimed in claim 14 where a distance from said upper surface of said spine beneath said top of said grid is substantially constant throughout a length of said spine.

20. A ramp as claimed in claim 1 wherein said ramp is constructed in one piece.

21. A ramp as claimed in claim 1 wherein said grid has a longitudinal rib down said centreline, said longitudinal rib being the only longitudinal rib located between said sides that is not part of said spine.

22. A ramp as claimed in claim 4 wherein said grid extending upward from said spine has a different size from said grid extending beneath said spine.

23. A ramp as claimed in claim 1 wherein said ramp has a friction surface near said first end in contact with said supporting surface.

24. A ramp as claimed in claim 1 wherein said ramp does not have a continuous supporting surface extending between said sides from said first end to said second end.

25. A portable ramp for use on a supporting surface for raising part of a wheeled motor vehicle above said surface, said ramp comprising a sloped portion and an upper portion, said ramp having a top, a bottom, two sides, and two ends, being a lower end and an upper end, with a grid being oriented substantially vertically between said sides and between said ends and a longitudinal spine being imbedded in said grid, said spine having an arc-shaped cross-section that is open towards said bottom, said ramp being sized and shaped to enable one wheel of said vehicle to travel in contact with said grid from said lower to said upper end.

* * * * *